United States Patent [19]

Weaver

[11] Patent Number: 4,675,657

[45] Date of Patent: Jun. 23, 1987

[54] ELECTROMAGNETIC SURVEILLANCE SYSTEM WITH IMPROVED SIGNAL PROCESSING

[75] Inventor: Jon N. Weaver, Lake Park, Fla.

[73] Assignee: Controlled Information Corporation, Lake Park, Fla.

[21] Appl. No.: 838,163

[22] Filed: Mar. 10, 1986

[51] Int. Cl.[4] ..... G08B 13/22

[52] U.S. Cl. ..... 340/551; 340/572

[58] Field of Search ..... 340/572, 551

[56] References Cited

U.S. PATENT DOCUMENTS

| | | | |
|---|---|---|---|
| 3,790,945 | 2/1974 | Feavon | 340/572 |
| 3,983,552 | 9/1976 | Bakeman, Jr. et al. | 340/572 |
| 4,063,230 | 12/1977 | Purinton et al. | 340/572 |
| 4,309,697 | 1/1982 | Weaver | 340/572 |

*Primary Examiner*—Glen R. Swann, III

*Attorney, Agent, or Firm*—Steele, Gould & Fried

[57] ABSTRACT

Markers carried in an interrogation zone by articles to be monitored are subjected to an electromagnetic field varying in time at a fundamental frequency and respond by generating signals at harmonic frequencies of the fundamental frequency, characteristic of soft magnetic materials. The system comprises: a transmitter for the electromagnetic field signal; a receiver and processor for signals generated by the article markers; and, a clock for phase locking the transmitter, the receiver and processor with one another. Signal information corresponding to at least one even order harmonic of the fundamental frequency in the received signals is tested for, and the duration thereof is measured. Signal information corresponding to at least one odd order harmonic is tested for, and if present, the phase angle thereof is measured. An alarm condition is signaled whenever the at least one even order harmonic endures for a predetermined time period, and the at least one odd harmonic, if present, is in proper phase with the transmitted signal. The alarm is inhibited whenever the phase angle of the at least one odd harmonic is improper, or broad band noise with random phase angles is detected and measured. Sensitivity to valid alarm conditions is substantially increased and occurrence of false alarms is substantially eliminated.

25 Claims, 1 Drawing Figure

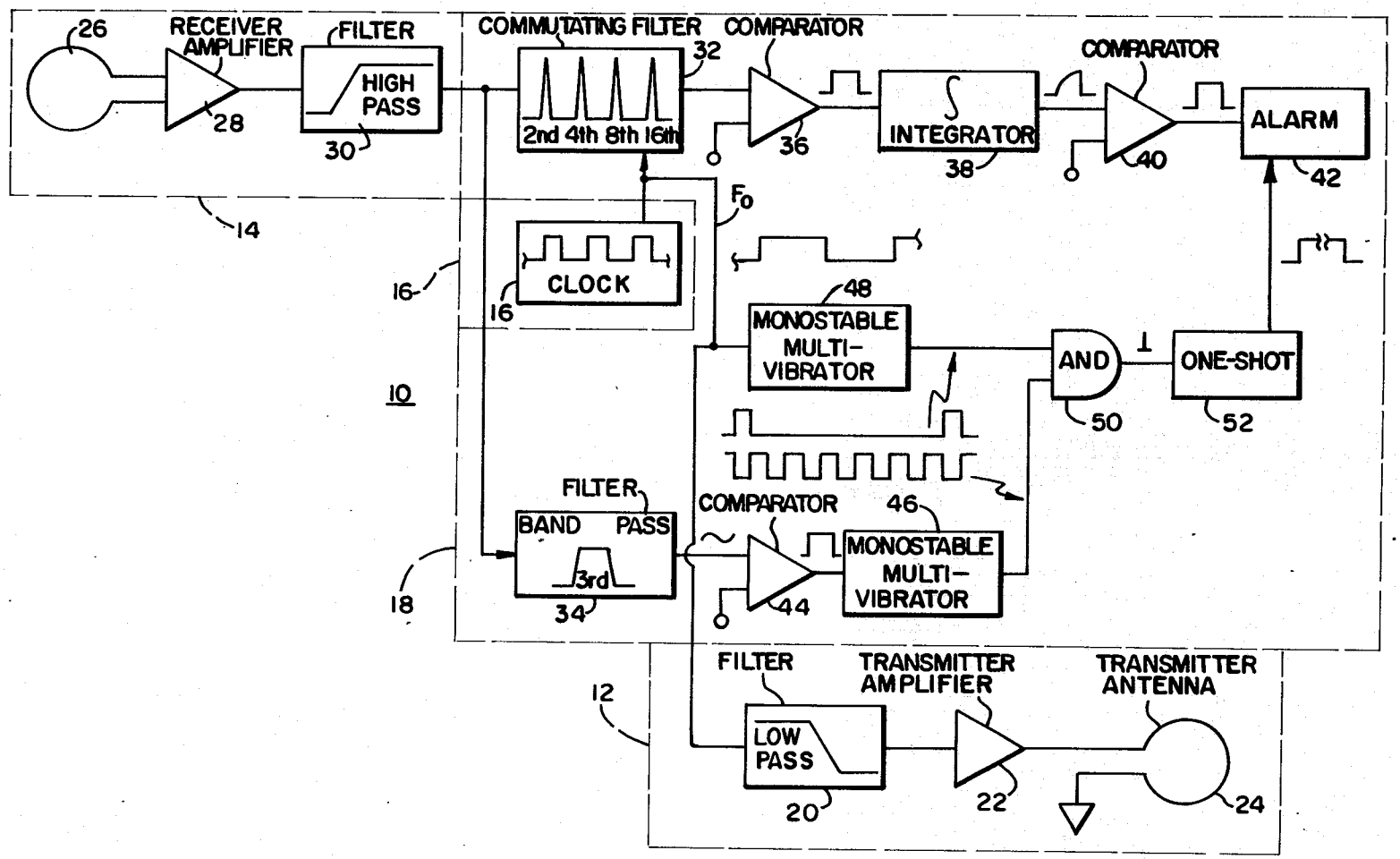
ALARM
42
COMPARATOR
40
INTEGRATOR
38
COMPARATOR
36
COMMUTATING FILTER
32
2nd 4th 8th 16th
FILTER
HIGH PASS
30
RECEIVER AMPLIFIER
28
26
14
16
10
18
CLOCK
16
$F_0$
MONOSTABLE MULTI-VIBRATOR
48
AND
50
ONE-SHOT
52
MONOSTABLE MULTI-VIBRATOR
46
COMPARATOR
44
FILTER
BAND PASS
3rd
34
TRANSMITTER ANTENNA
24
TRANSMITTER AMPLIFIER
22
FILTER
LOW PASS
20
12

ELECTROMAGNETIC SURVEILLANCE SYSTEM WITH IMPROVED SIGNAL PROCESSING

BACKGROUND OF THE INVENTION

FIELD OF THE INVENTION

The invention relates to electromagnetic surveillance systems with improved signal processing, and in particular, to theft deterrent systems wherein magnetic markers are carried by articles to be protected.

STATEMENT OF ART

Article surveillance systems using soft magnetic materials and low frequency detection systems have been known since the Picard patent No. (763,861) was issued in France in 1934. Picard discovered that when a piece of metal is subjected to a sinusoidally varying magnetic field, an induced voltage, characteristic of the metal composition, is produced in a pair of balanced coils in the vicinity of the applied field. Today, such systems utilize the harmonics produced by a marker of soft magnetic material to detect the marker. Due to the nonlinear characteristics of such markers, groups of even and odd order harmonics can be produced simultaneously or individually. Odd order (1, 3, 5 . . . ) harmonics are produced by a symmetrical switching of the B/H loop. Even order (2, 4, 6 . . . ) harmonics are produced by a non-symmetrical switching condition, typically caused by a static magnetic bias internal or external to the material. The earth's magnetic field must also be taken into account in determining magnetic bias external to a system.

The nonlinear characteristics of the soft magnetic material, while not commonly found, can be duplicated in some ferrous alloys by the presence of a magnetic bias. This results in the generation of even and odd order harmonics that duplicate the response of soft magnetic materials, such alloys including, for example, permalloy and the metallic glass products. However, the use of more sensitive detection equipment can add to the probability of false alarms due to ferrous alloys.

Most electromagnetic surveillance systems are of the kind in which markers carried in an interrogation zone by articles to be monitored are subjected to an electromagnetic field signal varying in time at a fundamental frequency and respond by generating signals, at harmonic frequencies of the fundamental frequency, characteristic of soft magnetic materials, the system having a signal transmitting means and a signal receiving and processing means for marker generated signals. Improvements in system response are measured by reliability in detecting alarm conditions. This is actually a twofold measurement, requiring increased sensitivity to the detection of valid alarm conditions, and at the same time, requiring greater protection against the invalid detection of false alarm conditions. Improvements in system response can relate to any one of, or any number of the transmitter circuitry, the receiver circuitry, the antenna design and coupling circuitry and the signal processing circuitry. The invention described herein is most particularly directed to the signal processing aspect of electromagnetic surveillance systems.

The first method for signal processing, developed by Picard, involved the selection of soft magnetic materials from which to make markers, rather than other ferrous objects. The soft magnetic material generated high order harmonics which could be processed with electric circuitry available at the time. More particularly, Picard sought to process the high order harmonics and to exclude the low order harmonics, such as the third and fifth harmonics. Alternatively, Picard suggested magnetizing the marker material to produce the more unique, even order products for detection.

Modern surveillance systems are more sensitive and selective than Picard's original system. Most of the harmonic spectrum is, or has been used in one form or another to select and utilize characteristics most unique to the soft magnetic materials. As material science improves and the magnetic materials become even softer, having lower coercive forces and lower saturation levels, some characteristics become more distinguishable than others, and therefore easier to identify. A result of such materials becoming softer has been the ability to reliably produce even order harmonics at higher power levels.

U.S. Pat. No. 3,790,945 describes a system wherein both even and odd harmonics are detected. A predetermined ratio is established for selected even and odd products. Identification of that predetermined ratio in a received signal is deemed indicative of an alarm condition. The system measures only the relative and absolute amplitudes of those harmonics which are processed.

A surveillance system is disclosed in U.S. Pat. No. 3,983,552 which utilizes an easily magnetized layer of Permalloy and a control layer of difficult to magnetize Vicalloy or Remendur. When the control layer of such markers is magnetized, and the markers thereafter interrogated in a detection zone, presence of the marker is detected by a circuit for measuring and identifying the amplitude and phase of the received second harmonic signal. If the phase of the incoming signal was directly in phase or 180° out of phase, and exceeded a given amplitude, an alarm is triggered.

A surveillance system described in U.S. Pat. No. 4,063,230 describes a system in which both the amplitude and phase of the incoming signal is monitored, an alarm being signalled whenever both quantities fall within a predetermined range. Although the detection of second harmonic signals improved sensitivity, such systems were still unacceptably prone to false alarms. False alarms are a serious problem, sometimes resulting not only in the alienation of customers, but in legal actions for damages as well.

The problem of simultaneously increasing system sensitivity while reducing the likelihood of false alarms is addressed in U.S. Pat. No. 4,309,697, wherein both the second and third harmonics are processed. More particularly, the system seeks to identify the amplitude and phase of the second harmonic signals and the amplitude of the third harmonic signals. The detection method relies on the unique characteristic of the second harmonic phase generated by soft magnetic materials, rejecting materials generating an abundance of third harmonic signals. This system could prove difficult to implement in the field, and it is uncertain that the system could ever be operable as described, since even order phase is subject to the bias of any magnetic field, including the earth's magnetic field, and is therefore unpredictable.

The most serious problem associated with all of the prior art surveillance systems and detection schemes, including those described above in detail, was and is the inability to discern differences between genuine marker characteristics and the characteristics of other objects, which led to false alarms. In most such systems, the occurrence of odd order harmonics of any sort was considered sufficient reason to inhibit the alarm, thereby reducing the detection rate.

It happens that most ferrous objects generate odd order harmonics, especially the thin sheet steel found in office equipment, display racks, shelves and checkout counters. Hence, suppresion of alarm detection whenever odd order harmonics are present, particularly third order harmonics, seemed necessary. Since soft markers easily generate such third harmonics, the avoidance of the third harmonic naturally reduced detection of valid alarm conditions. Few materials generate even order products. As a consequence, detection systems relying on the second harmonic have improved false alarm rates. Use of the second harmonic phase is still a desirable approach to improve the distinguishability of the signal and reduce false alarms. However, the phase of the second harmonic is dependent upon the coercive force of the material from which the marker is made and any magnetic bias which may be present. Conditions for establishing the phase of this second harmonic in soft materials are not always constant, as in the generated phase angle. Additionally, the phase angle can be, and often is duplicated by harder materials when under a magnetic bias, particularly shopping carts.

Although some of the signal processing techniques used in the surveillance systems described above have been effective in reducing the number of false alarms, that level is still unacceptably high in many appropriate environments. Moreover, the detection of third harmonic signals, and the resultant alarm inhibition, reduce the detection of valid alarm conditions.

The electromagnetic surveillance system disclosed herein overcomes the problems plaguing the prior art by relying upon the probabilities of materials generating a second harmonic and generating a third harmonic at a specific and unique phase angle. The phase angle of the third harmonic is not subject to bias conditions, is highly stable, and is therefore predictable. The combination of using the second harmonic and the phase of the third generates a most distinguishable signal, much more distinguishable than the second harmonic and the phase of the second harmonic. Moreover, use of the third harmonic as a valid marker signal increases the detection rate above those systems where any third harmonic causes alarm inhibition.

SUMMARY OF THE INVENTION

It is an object of this invention to provide an improved electromagnetic surveillance system.

It is another object of this invention to provide an improved electromagnetic surveillance system for markers carried by articles to be monitored.

It is yet another object of this invention to provide improved signal processing for new and for existing electromagnetic surveillance systems.

It is yet another object of this invention to provide improved methods for electromagnetic surveillance.

These and other objects are accomplished by an electromagnetic surveillance system, of the kind in which markers carried in an interrogation zone by articles to be monitored are subjected to an electromagnetic field varying in time at a fundamental frequency and respond by generating signals at harmonic frequencies of the fundamental frequency, characteristic of soft magnetic materials, the system comprising: means for transmitting into an interrogation zone a time-varying electromagnetic field signal at a fundamental frequency; means for receiving and processing signals generated by article markers in the interrogation zone responsive to the electromagnetic field signal; clock means for phase locking the transmitting and the receiving and processing means with one another; first means for detecting the presence of and measuring the duration of signal information corresponding to at least one even order harmonic of the fundamental frequency in the received signals; second means for detecting the presence of and measuring the phase angle of signal information corresponding to at least one odd harmonic of the fundamental frequency in the received signals; and, third means for signalling an alarm condition whenever: (a.) the at least one even order harmonic endures for a predetermined time period, and (b.) the at least one odd harmonic, if present, is in proper phase with the transmitted signal, the signalling means being inhibited whenever any one of: (a.) the phase angle of the at least one odd harmonic is improper, and (b.) broad band noise with random phase angles is detected and measured by the second means, whereby sensitivity to valid alarm conditions is substantially increased and occurrence of false alarms is substantially eliminated.

These and other objects are also accomplished by an improved signal processor for an electromagnetic surveillance system, of the kind in which markers carried in an interrogation zone by articles to be monitored are subjected to an electromagnetic field signal varying in time at a fundamental frequency and respond by generating signals, at harmonic frequencies of the fundamental frequency, characteristic of soft magnetic materials, the system having a signal transmitting means, a signal receiving and processing means for marker generated signals, and a clock means for phase locking the transmitting means and the receiving and processing means to one another, the signal processor comprising: first processing means for detecting the presence of and measuring the duration of signal information corresponding to at least one even order harmonic of the fundamental frequency in received signals; stored processing means for detecting the presence of and measuring the phase angle of signal information corresponding to at least one odd harmonic of the fundamental frequency in the received signals; and, third processing means for signalling an alarm condition whenever: (a.) the at least one even order harmonic endures for a predetermined time period, and (b.) the at least one odd harmonic, if present, is in proper phase with the transmitted signal, the signalling means being inhibited whenever any one of: (a.) the phase angle of the at least one odd harmonic is improper, and (b.) broad band noise with random phase angles is detected and measured by the second processing means, whereby sensitivity to valid alarm conditions is substantially increased and occurrence of false alarms is substantially eliminated.

These and other objects are further accomplished by a method for electromagnetic surveillance of markers carried in an interrogation zone by articles to be monitored, the markers being of the kind which respond to an electromagnetic field varying in time at a fundamental frequency by generating signals, at harmonic frequencies of the fundamental frequency, characteristic of soft magnetic materials, the method comprising the steps of: transmitting into an interrogation zone a time-varying electromagnetic field signal at a fundamental frequency; receiving and processing signals generated by article markers in the interrogation zone response to the electromagnetic field; phase locking the transmitting and the receiving and processing steps; detecting the presence of and measuring the duration of signal information corresponding to at least one even order harmonic of the fundamental frequency in the received signals; detecting the presence of and measuring the phase angle of signal information coresponding to at least one odd harmonic of the fundamental frequency in the received signals; signalling an alarm condition whenever: (a.) the at least one even order harmonic endures for a predetermined time period, and (b.) the at least one odd harmonic, if present, is in proper phase with the transmitted signal; and, inhibiting the signalling of an alarm condition whenever any one of: (a.) the phase angle of the at least one odd harmonic is improper, and (b.) broad band noise with random phase angles is detected and measured, irrespective of detecting duration of the at least one even order harmonic, whereby sensitivity to valid alarm conditions is substantially increased and occurrence of false alarms is substantially eliminated.

In the presently preferred embodiments, the invention relies upon the probabilities of materials generating a second harmonic and generating a third harmonic at a specific and unique phase angle. The phase angle of the third harmonic is not subject to bias conditions, is highly stable, and is therefore predictable. The combination of using the second harmonic and the phase of the third generates a most unique signal, much more unique that the second harmonic and the phase of the second harmonic. Moreover, use of the third harmonic as a valid marker signal increases the detection rate above those systems where any third harmonic causes alarm inhibition.

BRIEF DESCRIPTION OF THE DRAWING

An electromagnetic surveillance system according to this invention is shown in block diagram form in the single FIGURE, including schematic depiction of certain circuit elements and signal waveform shapes.

DETAILED DESCRIPTION OF THE PREFERRED EMBODIMENT

An electromagnetic surveillance system, incorporating improved signal processing techniques, is shown in block diagram form in the FIGURE, and generally designated by reference numeral 10. The electromagnetic surveillance system 10 comprises a transmitting means or circuit 12 and a receiving/processing means or circuit 14/18. The transmitter 12 and the receiver/-processor 14/18 are phase locked to one another by a clock means or master clock 16. The clock 16 generates phase locked square wave signals, one of which is used as the fundamental frequency ($F_0$) signal that is transmitted into an interrogation zone. The fundamental signal is filtered by a low pass filter 20 to remove nearly all harmonics prior to amplification and transmission, particularly the second and third harmonics. This filtering is to ensure that any harmonic signals present in the interrogation zone result from markers or articles in the interrogation zone, and not from the system itself. The transmitter includes an amplifier 22 which transforms the voltage signal of the fundamental frequency into a current wave form. The current wave form is coupled to an antenna 24 and radiated into a three dimensional space comprising the interrogation zone.

Articles to be monitored as they pass through the interrogation zone carry a marker of soft magnetic material which, when subjected to an electromagnetic field varying in time at the fundamental frequency, response by generating signals at harmonic frequencies of the fundamental frequency, a characteristic of soft magnetic materials. Alternatively, the articles to be monitored may carry markers composed of a ferrous material, such as sheet steel or iron, which respond in a manner characteristic of conventionally defined soft magnetic materials, namely by generating signals at harmonic frequencies of the fundamental frequency. The markers are usually formed as thin strips, ribbons or the like. The specific construction of the markers does not form a part of this invention, although the system 10 is adapted for use with markers showing a response characteristic of soft magnetic material.

The harmonic content signals generated by markers in the interrogation zone are coupled to the receiver 14 by an appropriate antenna 26 and applied to an input amplifier 28. After amplification, the signals are filtered through a high pass filter 30 in order to remove as much of the signal content as possible which represents the fundamental frequency, as well as removing other, unwanted low frequency signals. Only signals representative of the second harmonic and higher are passed through the filter 30. The output of the high pass filter 30 is a processing signal applied to both a phase locked, second harmonic commutating filter 32 and a third harmonic band pass filter 34. The commutating filter 32 has an extremely narrow band pass characteristic for the second harmonic, as well as the fourth harmonic, the eighth harmonic, the sixteenth harmonic, and so on. As a consequence, the attack time of the commutating filter is relatively slow. The third harmonic band pass filter 34 has a lower Q and consequently reacts much faster to third harmonic inputs.

If the second harmonic should appear first from the marker, it is passed by the commutating filter 32 to the input of a comparator 36 as a first intermediate processing signal. Comparator 36 is used to measure the signal to noise ratio, that is, to distinguish the second harmonic from merely noise. The comparator 36 generates a square wave output which is then integrated. The integrator 38 is essentially a time delay device which ensures reception of a fairly constant second harmonic for a predetermined period of time. The integrator also serves to integrate random noise spikes which may, from time to time, be received. After a sufficient amount of second harmonic signal is processed, a coupled comparator 40 provides a positive signal output to an alarm device 42, and an alarm is generated.

The minimum or predetermined period of time will depend on the system environment. If a specific marker material is to be detected, and the environment itself makes false alarms unlikely, than a few milliseconds might suffice. On the other hand, if the risk of false alarms is very high due to to other materials known to be moving in the interrogation zone, then time periods of 150 to 250 milliseconds might be necessary. An adjustment capacity for calibration after installation is accordingly desirable.

Should a third harmonic signal be received at the same time, or prior to reception of the second harmonic signal, the third harmonic signal is passed through the band pass filter 34 as a second intermediate processing signal, and thereafter distinguished from noise by a second comparator 44 measuring a signal to noise ratio, as for the output of the commutating filter. When distinguished from noise, the comparator provides a squared output which is in turn applied to the trigger of a monostable multivibrator 46. The monostable multivibrator produces a positive pulse of predetermined duration for each negative and each positive edge of each pulse to the third harmonic signal. In this manner, a third harmonic signal which is either directly in phase with the fundamental frequency signal, or 180° out of phase with the fundamental frequency signal, will result in an output at a constant phase angle. The phase may change with orientation of the marker in the interrogation zone and both phase relationships must be tested. This output is applied to one input of a logical AND gating means 50.

The other input of the AND gate 50 is derived from the fundamental frequency signal provided by the master clock 16, which has had the positive portion of its period shortened by a monostable multivibrator 48 to be equal to the negative portion of the other AND gate input. In effect, the fundamental frequency signal generated by the clock becomes a phase reference for the processed third harmonic signal. The system is thereafter adjusted until the fundamental frequency signal's positive pulse is 180° out of phase with the negative portion of the processed third harmonic signal being radiated by a marker. As a consquence, no output is generated by the AND gate 50 and a one short 52 connected to the output of the AND gate 50 is not fired, and does not generate a signal which can inhibit the alarm otherwise activated by processing and identification of a second harmonic signal from the commutating filter, which second harmonic signal is distinguished from noise, and which endures for the predetermined period of time. However, should a material (for example, a ferrous material) generate a third harmonic signal with different phase angles, the AND gate 50 will output pulses which cause the one shot 52 to fire a signal pulse which inhibits the alarm 42. The wider band width of the third harmonic band pass filter 34, relative to the commutating filter 32, ensures a more rapid response to the reception of third harmonic signal for instances where a false alarm might occur. Moreover, wide band noise with its random phase characteristics will be processed by the third harmonic band pass filter and its associated processing circuitry, in the same manner as third harmonic signals produced by ferrous objects, therefore resulting in the generation of signals which inhibit the alarm.

Accordingly, the necessary conditions for signalling an alarm according to this processing technique are:

1. determining that the even order harmonic signal endures for a predetermined time period, and 2. if the third harmonic is present, determining that the third harmonic is in proper phase relationship with the transmitted signal. The first requirement is sufficient to enable the alarm if no third order harmonic is detected. Both requirements are necessary to enable the alarm if a third order harmonic signal is detected. The conditions under which the alarm will be inhibited, notwithstanding detection of a second harmonic signal for a predetermined period of time; are:

1. detection of a third harmonic signal having an improper phase angle, or 2. the detection of broad band noise with random phase angles. Either requirement is sufficient to inhibit the alarm.

It will be apparent that the signal processing technique according to this invention does not measure the absolute, respective or relative amplitudes of the harmonic signals. It is necessary only that the detection of the even and odd harmonic signals be distinguished from noise, for example by use of comparators 36 and 44 as threshold detectors. Moreover, the phase measurement of the odd harmonic is completely digital, by reason of utilizing monostable multivibrators 46 and 48, and logical AND-gating means 50.

The commutating filter 32, comparator 36, integrator 38 and comparator 40 may be thought of as a first processing means for detecting the presence and duration of signal information corresponding to at least one even order harmonic of the fundamental frequency in the received signal generally, and corresponding to the 2nd, 4th, 8th, 16th . . . harmonics in particular. The band pass filter 34, comparator 44, monostable multivibrators 46 and the operation of AND-gating means 50 (at least in part) may be thought of as a second processing means for detecting the presence of and measuring the phase angle of signal information corresponding to at least one odd harmonic of the fundamental frequency in the received signal generally, and corresponding to the third harmonic in particular. The AND-gating means 50 (at least in part), the one shot 52 and the inhibitable operation of alarm 42 may be thought of as a third processing means for signalling an alarm condition whenever a marker is detected. These definitions are somewhat arbitrary, and are suggested for convenience in analysis. The inclusion of the AND-gating means 50 in both the second and third processing means (at least in part, respectively) is not inconsistent, but a measure of the elegance in simplicity of the circuitry of the presently preferred embodiment. Likewise, the high pass filter 30 may be considered part of the receiving means 14 as shown, or as part of the processing means 18.

The specific electronic components from which surveillance systems according to this invention may be constructed do not form a part of this invention, in and of themselves, and are not described in detail. Various and specific designs for transmitters, receivers, antennas and filters are well known in the art generally and in the patent literature. Indeed, the invention may be embodied in a method for conducting electronic surveillance, apart from any circuit means in particular.

Generally, a method for electromagnetic surveillance of markers carried in an interrogation zone by articles to be monitored, the markers being of the kind which respond to an electromagnetic field varying in time at a fundamental frequency by generating signals, at harmonic frequencies of the fundamental frequency, characteristic of soft magnetic materials, comprises the steps of: transmitting into an interrogation zone a time-varying electromagnetic field signal at a fundamental frequency; receiving and processing signals generated by article markers in the interrogation zone responsive to the electromagnetic field; phase locking the transmitting and the receiving and processing steps; detecting the presence of and measuring the duration of signal information corresponding to at least one even order harmonic of the fundamental frequency in the received signals; detecting the presence of and measuring the phase angle of signal information corresponding to at least one odd harmonic of the fundamental frequency in the received signals; signalling an alarm condition whenever:

(a) the at least one even order harmonic endures for a predetermined time period, and (b) the at least one odd harmonic, if present, is in proper phase with the transmitted signal; and, inhibiting the signalling of an alarm condition whenever any one of:

(a) the phase angle of the at least one odd harmonic is improper, and (b) broad band noise with random phase angles is detected and measured, whereby sensitivity to valid alarm conditions is substantially increased and occurrence of false alarms is substantially eliminated.

More particularly, the method comprises the further steps of: generating a first intermediate processing signal of all detectable even order harmonics of the fundamental frequency from the received signals; distinguishing between the first intermediate processing signal and noise; measuring the duration of the first intermediate processing signal when distinguished form noise and generating an alarm output signal when the duration exceeds the predetermined time period; continuously generating alarm inhibit pulses responsive to the leading and trailing edges of each pulse of the clock means; generating a second intermediate processing signal of the third harmonic of the fundamental frequency from the received signals; distinguishing between the second intermediate processing signal and noise; measuring the phase angle of the second intermediate processing signal when distinguished from noise to determine whether the second intermediate processing signal is one of: (a) directly in phase, and (b) 180 degrees out of phase, with the transmitted signal, indicating a proper phase relationship; preventing propagation of each alarm inhibit pulse coinciding in time with one of the alarm control pulses, but enabling propagation of each alarm inhibit pulse not time coincident with an alarm control pulse; and, signalling an alarm condition at the simultaneous presence of the alarm output signal, based on processing the even order harmonics, and the absence of the alarm control pulses, based on processing the third harmonic, whereby an alarm signal is continuously suppressed even though enduring even order harmonics of the fundamental frequency are detected unless the third harmonic of the fundamental frequency is also detected and exhibits a proper phase relationship with the transmitted signal.

This invention may be embodied in other specific forms without departing from the spirit or essential attributes thereof. Accordingly, reference should be made to the appended claims, rather than the foregoing specification, as indicating the scope of the invention.

What is claimed is:

1. An electromagnetic surveillance system, of the kind in which markers carried in an interrogation zone by articles to be monitored are subjected to an electromagnetic field varying in time at a fundamental frequency and respond by generating signals at harmonic frequencies of the fundamental frequency, characteristic of soft magnetic materials, the system comprising:

means for transmitting into an interrogation zone a time-varying electromagnetic field signal at a fundamental frequency;

means for receiving and processing signals generated by article markers in the interrogation zone responsive to the electromagnetic field signal;

clock means for phase locking the transmitting and the receiving and processing means with one another;

first means for detecting the presence of and measuring the duration of signal information corresponding to at least one even order harmonic of the fundamental frequency in the received signals;

second means for detecting the presence of and measuring the phase angle of signal information corresponding to at least one odd harmonic of the fundamental frequency in the received signals; and, third means for signalling an alarm condition whenever:

(a) the at least one even order harmonic endures for a predetermined time period, and (b) the at least one odd harmonic, if present, is in proper phase with the transmitted signal, the signalling means being inhibited whenever any one of:

(a) the phase angle of the at least one odd harmonic is improper, and (b) broad band noise with random phase angles is detected and measured by the second means, whereby sensitivity to valid alarm conditions is substantially increased and occurrence of false alarms is substantially eliminated.

2. The system of claim 1, wherein the transmitting means comprises low pass filtering means for substantially removing harmonic information content from the transmitted signal.

3. The system of claim 1, wherein the receiving and processing means comprises high pass filtering means for producing processing signals from the received signals by substantially removing signal information corresponding to the fundamental frequency.

4. The system of claim 1, wherein the first means comprises:

commutating filtering means for producing an intermediate processing signal of all detectable even order harmonics of the fundamental frequency from the received signals;

threshold detecting means for distinguishing between the intermediate processing signal and noise; and, integrating means for measuring the duration of the intermediate processing signal when distinguished from noise and producing an alarm output signal when the duration exceeds the pretermined time period.

5. The system of claim 4, wherein the second means comprises:

band pass filtering means for producing a second intermediate processing signal of the third harmonic of the fundamental frequency from the received signals;

threshold detecting means for distinguishing between the second intermediate processing signal and noise;

phase angle measuring means for determining whenever the second intermediate processing signal is one of:

(a) directly in phase, and (b) 180 degrees out of phase with the transmitted signal; and, means for generating an alarm inhibit signal whenever the determination of the phase angle measuring means is unsatisfied.

6. The system of claim 5, wherein the third means comprises:

first monostable vibrating means for generating alarm inhibit digital pulses responsive to the leading and trailing edges of each pulse of the clock means;

second monostable vibrating means for generating digital pulses at each valid detection of the at least one odd order harmonic in the received signal; and, logical AND-gating means for preventing propagation of each alarm inhibit pulse coinciding in time with one of the valid detection pulses, the AND-gating means passing an alarm inhibit digital pulse in the absence of the pulse coincidence.

7. The system of claim 4, wherein the third means comprises:

first monostable vibrating means for generating alarm inhibit digital pulses responsive to the leading and trailing edges of each pulse of the clock means;

second monostable vibrating means for generating digital pulses at each valid detection of the at least one odd order harmonic in the received signal; and, logical AND-gating means for preventing propagation of each alarm inhibit pulse coinciding in time with one of the valid detection pulses, the AND-gating means passing an alarm inhibit digital pulse in the absence of the pulse coincidence.

8. The system of claim 1, wherein the second means comprises:

band pass filtering means for producing an intermediate processing signal of the third harmonic of the fundamental frequency from the received signals;

threshold detecting means for distinguishing between the intermediate processing signal and noise;

phase angle measuring means for determining whenever the intermediate processing signal is one of:

(a) directly in phase, and (b) 180 degrees out of phase with the transmitted signal; and, means for generating an alarm inhibit signal whenver the determination of the phase angle measuring means is unsatisfied.

9. The system of claim 8, wherein the third means comprises:

first monostable vibrating means for generating alarm inhibit digital pulses responsive to the leading and trailing edges of each pulse of the clock means;

second monostable vibrating means for generating digital pulses at each valid detection of the at least one odd order harmonic in the received signal; and, logical AND-gating means for preventing propagation of each alarm inhibit pulse coinciding in time with one of the valid detection pulses, the AND-gating means passing an alarm inhibit digital pulse in the absence of the pulse coincidence.

10. The system of claim 1, wherein the third means comprises:

first monostable vibrating means for generating alarm inhibit pulses responsive to the leading and trailing edges of each pulse of the clock means;

second monostable vibrating means for generating pulses at each valid detection of the at least one odd order harmonic in the received signal; and, logical AND-gating means for preventing propagation of each alarm inhibit pulse coinciding in time with one of the valid detection pulses, the AND-gating means passing an alarm inhibit pulse in the absence of the pulse coincidence.

11. The system of claim 1, wherein:

the transmitting means comprises low pass filtering means for substantially removing harmonic information content from the transmitted signal; and, the receiving and processing means comprises high pass filtering means for producing processing signals from the received signals by substantially removing signal information corresponding to the fundamental frequency.

12. The system of claim 1, wherein: the first means comprises:

commutating filtering means for producing a first intermediate processing signal of all detectable even order harmonics of the fundamental frequency from the received signals;

threshold detecting means for distinguishing between the first intermediate processing signal and noise; and, integrating means for measuring the duration of the first intermediate processing signal when distinguished from noise and producing an alarm output signal when the duration exceeds the predetermined time period; the second means comprises:

band pass filtering means for producing a second intermediate processing signal of the third harmonic of the fundamental frequency from the received signals;

threshold detecting means for distinguishing between the second intermediate processing signal and noise;

phase angle measuring means for determining whenever the second intermediate processing signal is one of:

(a) directly in phase, and (b) 180 degrees out of phase with the transmitted signal; and, means for generating an alarm inhibit signal whenever the determination of the phase angle measuring means is unsatisfied; and, the third means comprises:

first monostable vibrating means for generating alarm inhibit digital pulses responsive to the leading and trailing edges of each pulse of the clock means;

second monostable vibrating means for generating digital pulses at each valid detection of the at least one odd order harmonic in the received signal; and, logical AND-gating means for preventing propagation of each alarm inhibit pulse coinciding in time with one of the valid detection pulses, the AND-gating means passing an alarm inhibit digital pulse in the absence of the pulse coincidence.

13. The system of claim 1, wherein the third means comprises digital circuit processing means responsive only to:

(a) the presence or absence of the at least one even order harmonic in the received signal;

(b) the presence or absence of the at least one odd order harmonic in the received signal; and, (c) the phase of the at least one odd order harmonic, if present, relative to the transmitted signal, the absolute, respective and relative amplitudes of the at least one even and odd harmonic signals being irrelevant.

14. An improved signal processor for an electromagnetic surveillance system, of the kind in which markers carried in an interrogation zone by articles to be monitored are subjected to an electromagnetic field signal varying in time at a fundamental frequency and respond by generating signals, at harmonic frequencies of the fundamental frequency, characteristic of soft magnetic materials, the system having a signal transmitting means, a signal receiving and processing means for marker generated signals, and a clock means for phase locking the transmitting means and the receiving and processing means to one another, the signal processor comprising:

first processing means for detecting the presence of and measuring the duration of signal information corresponding to at least one even order harmonic of the fundamental frequency in received signals;

second processing means for detecting the presence of and measuring the phase angle of signal information corresponding to at least one odd harmonic of the fundamental frequency in the received signals; and, third processing means for signalling an alarm condition whenever:

(a) the at least one even order harmonic endures for a predetermined time period, and (b) the at least one odd harmonic, if present, is in proper phase with the transmitted signal, the signalling means being inhibited whenever any one of:

(a) the phase angle of the at least one odd harmonic is improper, and (b) broad band noise with random phase angles is detected and measured by the second processing means, whereby sensitivity to valid alarm conditions is substantially increased and occurrence of false alarms is substantially eliminated.

15. The signal processor of claim 14, wherein the first processing means comprises:

commutating filtering means for producing an intermediate processing signal of all detectable even order harmonics of the fundamental frequency from the received signals;

threshold detecting means for distinguishing between the intermediate processing signal and noise; and, integrating means for measuring the duration of the intermediate processing signal when distinguished from noise and producing an alarm output signal when the duration exceeds the predetermined time period.

16. The signal processor of claim 14, wherein the second processing means comprises:

band pass filtering means for producing an intermediate processing signal of the third harmonic of the fundamental frequency from the received signals;

threshold detecting means for distinguishing between the intermediate processing signal and noise;

phase angle measuring means for determining whenever the intermediate processing signal is one of:

(a) directly in phase, and (b) 180 degrees out of phase with the transmitted signal; and, means for generating an alarm inhibit signal whenever the determination of the phase angle measuring means is unsatisfied.

17. The signal processor of claim 14, wherein the third processing means comprises:

first monostable vibrating means for generating alarm inhibit pulses responsive to the leading and trailing edges of each pulse of the clock means;

second monostable vibrating means for generating pulses at each valid detection of the at least one odd order harmonic in the received signal; and, logical AND-gating means for preventing propagation of each alarm inhibit pulse coinciding in time with one of the valid detection pulses, the AND-gating means passing an alarm inhibit pulse in the absence of the pulse coincidence.

18. The signal processor of claim 14, wherein: the first processing means comprises:

commutating filtering means for producing a first intermediate processing signal of all detectable even order harmonics of the fundamental frequency from the received signals;

threshold detecting means for distinguishing between the first intermediate processing signal and noise; and, integrating means for measuring the duration of the first intermediate processing signal when distinguished form noise and producing an alarm output signal when the duration exceeds the predetermined time period; the second processing means comprises:

band pass filtering means for producing a second intermediate processing signal of the third harmonic of the fundamental frequency from the received signals;

threshold detecting means for distinguishing between the second intermediate processing signal and noise;

phase angle measuring means for determining whenever the second intermediate processing signal is one of:

(a) directly in phase, and (b) 180 degrees out of phase with the transmitted signal; and, means for generating an alarm inhibit signal whenever the determination of the phase angle measuring means is unsatisfied; and, the third processing means comprises:

first monostable vibrating means for generating alarm inhibit digital pulses responsive to the leading and trailing edges of each pulse of the clock means;

second monostable vibrating means for generating digital pulses at each valid detection of the at least one odd order harmonic in the received signal; and, logical AND-gating means for preventing propagation of each alarm inhibit pulse coinciding in time with one of the valid detection pulses, the AND-gating means passing an alarm inhibit digital pulse in the absence of the pulse coincidence.

19. The processor of claim 14, wherein the third processing means comprises digital circuit processing means responsive only to:

(a) the presence or absence of the at least one even order harmonic in the received signal;

(b) the presence or absence of the at least one odd order harmonic in the received signal; and, (c) the phase of the at least one odd order harmonic relative to the transmitted signal, the absolute, respective and relative amplitudes of the at least one even and odd harmonics being irrelevant.

20. A method for electromagnetic surveillance of markers carried in an interrogation zone by articles to be monitored, the markers being of the kind which respond to an electromagnetic field varying in time at a fundamental frequency by generating signals, at harmonic frequencies of the fundamental frequency, characteristic of soft magnetic materials, the method comprising the steps of:

transmitting into an interrogation zone a time-varying electromagnetic field signal at a fundamental frequency;

receiving and processing signals generated by article markers in the interrogation zone responsive to the electromagnetic field;

phase locking the transmitting and the receiving and processing steps;

detecting the presence of and measuring the duration of signal information corresponding to at least one even order harmonic of the fundamental frequency in the received signals;

detecting the presence of and measuring the phase angle of signal information corresponding to at least one odd harmonic of the fundamental frequency in the received signals;

signalling an alarm condition whenever:

(a) the at least one even order harmonic endures for a predetermined time period, and (b) the at least one odd harmonic, if present, is in proper phase with the transmitted signal; and, inhibiting the signalling of an alarm condition whenever any one of:

(a) the phase angle of the at least one odd harmonic is improper, and (b) broad band noise with random phase angles is detected and measured, whereby sensitivity to valid alarm conditions is substantially increased and occurrence of false alarm is substantially eliminated.

21. The method of claim 20, comprising the step of digitally processing the signalling and inhibiting steps, and only in accordance with:

(a) the presence or absence of the at least one even order harmonic in the received signal;

(b) the presence or absence of the at least one odd order harmonic in the received signal; and, (c) the phase of the at least one odd order harmonic, if present, relative to the transmitted signal, the absolute, respective and relative amplitudes of the at least one even and odd harmonics being irrelevant.

22. The method of claim 20, wherein the step of detecting the presence of and measuring the duration of signal information corresponding to at least one even order harmonic of the fundamental frequency in the received signals comprises the further steps of:

generating an intermediate processing signal of all detectable even order harmonics of the fundamental frequency from the received signals;

distinguishing between the intermediate processing signal and noise; and, measuring the duration of the intermediate processing signal when distinguished from noise and generating an alarm output signal when the duration exceeds the predetermined time period.

23. The method of claim 20, wherein the step of detecting the presence of and measuring the phase angle of signal information corresponding to at least one odd harmonic of the fundamental frequency in the received signals comprises the further steps of:

generating an intermediate processing signal of the third harmonic of the fundamental frequency from the received signals;

distinguishing between the intermediate processing signal and noise;

measuring the phase angle to determine whenever the intermediate processing signal is one of:

(a) directly in phase, and (b) 180 degrees out of phase with the transmitted signal, indicating a proper phase relationship; and, generating an alarm inhibit signal whenever the measured phase angle is improper.

24. The method of claim 20, wherein the alarm signalling and inhibiting steps comprise the further steps of:

generating alarm inhibit pulses responsive to the leading and trailing edges of each pulse of a clock means;

generating pulses at each valid detection of the at least one odd order harmonic in the received signal; and, preventing propagation of each alarm inhibit pulse coinciding in time with one of the valid detection pulses, and generating an alarm inhibit pulse in the absence of the pulse coincidence.

25. The method of claim 20, comprising the further steps of:

generating a first intermediate processing signal of all detectable even order harmonics of the fundamental frequency from the received signals;

distinguishing between the first intermediate processing signal and noise;

measuring the duration of the first intermediate processing signal when distinguished form noise and generating an alarm output signal when the duration exceeds the predetermined time period;

continuously generating alarm inhibit pulses responsive to the leading and trailing edges of each pulse of a clock means;

generating a second intermediate processing signal of the third harmonic of the fundamental frequency from the received signals;

distinguishing between the second intermediate processing signal and noise;

measuring the phase angle of the second intermediate processing signal when distinguished from noise to determine whenever the second intermediate processing signal is one of:

(a) directly in phase, and (b) 180 degrees out of phase, with the transmitted signal, indicating a proper phase relationship;

preventing propagation of each alarm inhibit pulse coinciding in time with one of the alarm control pulses, but enabling propagation of each alarm inhibit pulse not time coincident with an alarm control pulse; and, signalling an alarm condition at the simultaneous presence of the alarm output signal, based on processing the even order harmonics, and the absence of the alarm control pulses, based on processing the third harmonic.

* * * * *